United States Patent [19]

Kitrell

[11] 4,332,263

[45] Jun. 1, 1982

[54] MANICURE EASEL

[76] Inventor: John V. Kitrell, 4639 Holdrege, Lincoln, Nebr. 68503

[21] Appl. No.: 148,770

[22] Filed: May 12, 1980

[51] Int. Cl.[3] ..... A45D 29/00

[52] U.S. Cl. ..... 132/73; 248/118

[58] Field of Search ..... 132/73, 73.5, 75; 248/363, 118, 118.1, 118.3, 118.5; 128/1 NQ

[56] References Cited

U.S. PATENT DOCUMENTS

| | | | |
|---|---|---|---|
| 2,020,100 | 11/1935 | Boyd | 132/73 |
| 3,765,638 | 10/1973 | Harrison | 248/363 |
| 3,961,636 | 6/1976 | Mele | 132/73 |

FOREIGN PATENT DOCUMENTS

| | | | |
|---|---|---|---|
| 42022 | 10/1965 | Fed. Rep. of Germany | 248/118 |
| 285997 | 5/1931 | Italy | 248/118.1 |
| 256704 | 3/1949 | Switzerland | 132/73.5 |

*Primary Examiner*—Robert A. Hafer

*Attorney, Agent, or Firm*—Zarley, McKee, Thomte, Voorhees & Seas

[57] ABSTRACT

A manicure easel is described for selectively supporting one hand of a person in a manicure position and for supporting the other hand of the person in a position to enable the other hand to perform manicure operations on the hand being supported. The easel comprises a first support which is adapted to be positioned on a horizontal supporting surface and selectively secured thereto. A finger support is provided on the first support for supporting the tip portion of the finger. A hand rest is secured to the first support and extends laterally therefrom for supporting the hand performing the manicure operations.

2 Claims, 6 Drawing Figures

MANICURE EASEL

BACKGROUND OF THE INVENTION

Many types of manicurist's supports have been provided which are designed to support one hand of the person during the operation of manicuring by a manicurist. For example, finger supports are disclosed in U.S. Pat. Nos. 968,965; 2,291,125; and 3,961,636. A manicurist's hand support is disclosed in U.S. Pat. No. 2,171,804 while a manicuring table is described in U.S. Pat. No. 2,147,314.

None of the prior art devices provide a means for conveniently supporting the hand upon which the manicuring operations are to be performed together with a support for supporting the other hand of the person. In other words, the prior art devices are generally designed to support a person's hand to enable a manicurist to perform the manicuring operations and do not contemplate providing a means for the person to perform the manicuring operations himself.

Therefore, it is a principal object of the invention to provide a manicure easel.

A further object of the invention is to provide a manicure easel which is designed to permit one hand of a person to be supported in a manicure position and to provide a means for supporting the other hand of the person in a position to perform the manicure operations on the supported hand.

A still further object of the invention is to provide a manicure easel which enables the manicuring hand to be supported either above or below the finger upon which the manicuring operations are being performed.

A still further object of the invention is to provide a manicure easel including a finger support which is mounted by means of a ball and socket support to enable the supported finger to be properly positioned.

A still further object of the invention is to provide a manicure easel which is economical of manufacture, durable in use and refined in appearance.

These and other objects will be apparent to those skilled in the art.

SUMMARY OF THE INVENTION

Figures 1, 2, 3, 4, 5, 6:
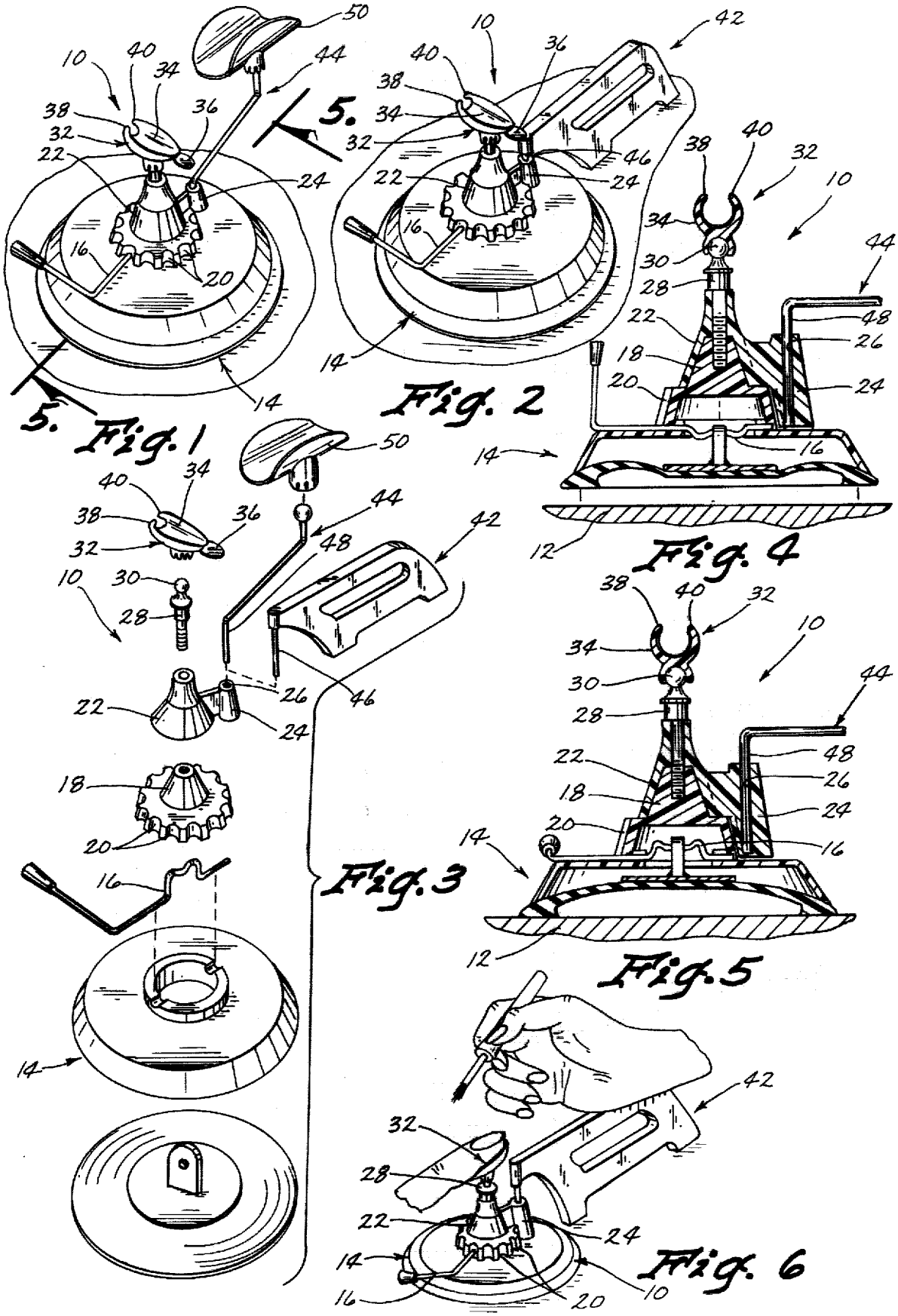
FIG. 1 is a perspective view of the invention.
FIG. 2 is a perspective view of the invention illustrating an alternative form of the hand support.
FIG. 3 is an exploded perspective view of the invention illustrating both forms of the hand support.
FIG. 4 is a sectional view of the invention as seen on lines 5—5 of FIG. 1.
FIG. 5 is a sectional view as seen on lines 5—5 of FIG. 1.
FIG. 6 is a perspective view of the embodiment of FIG. 2 illustrating the invention being used.

A manicure easel comprising a first support means adapted to be detachably secured to a horizontal supporting surface and having a finger support mounted thereon by means of a ball and socket arrangement for supporting the tip portion of the finger which is to be manicured. A hand rest is secured to the first support means and extends laterally therefrom for supporting the hand performing the manicuring operations.

DESCRIPTION OF THE PREFERRED EMBODIMENT

The manicure easel of this invention is referred to generally by the reference numeral 10 which is designed to be supported upon a flat horizontal supporting surface 12. Generally speaking, easel 10 includes a base portion 14 including a conventional suction mount to enable the base 14 to be removably secured to the supporting surface 12. Typical of such types of suction mounts is that disclosed in U.S. Pat. No. 3,765,638. In this example, the suction mechanism is controlled by means of the lever 16. A lock assembly crown cap 18 is mounted on the upper end of the base 14 and is provided with a plurality of grooves or flutes 20 extending around the periphery thereof. The numeral 22 refers to a conical shaped support which is rotatably mounted on the crown cap 18 and which has collar 24 positioned at one side thereof including bore 26 extending downwardly therethrough. Bore 26 is positioned over the flutes 20 as will be described in more detail hereinafter.

Pivot stem 28 is mounted in the upper end of the element 22 and has a ball 30 provided on its upper end adapted to receive an easel ring 32. Ring 32 may be of various sizes depending upon the particular finger size of the person having the manicuring operations performed thereon. Ring 32 includes an arcuate recess portion 34 which is adapted to engage the underside of the finger tip. The finger may be positioned in the recess 34 so that the fingernail is positioned over the filing template guide 36 or positioned so that the arcuate under nail finger grip portions 38 and 40 engage the underside of the fingernail the opposite sides thereof.

The numerals 42 and 44 refer to hand rests including pivot rod portions 46 and 48 respectively. Hand rest 42 is designed to be an underhand hand rest while hand rest 44 is designed to comprise an overhand hand rest. Hand rest 44 includes a trough portion 50 which is mounted thereon by means of a ball and socket arrangement. The pivot rod portions 46 and 48 are adapted to be received by the bore 26 and one of the grooves 20 as will be described in more detail hereinafter.

In use, the easel 10 is positioned on a flat supporting surface 12 and the suction mount actuated to maintain the base 14 in position. An easel ring 32 is detachably secured to the ball 30. Member 22 is then rotated to the desired position with pivot rod 46 of hand rest 42 then being inserted downwardly into the bore 26 and into one of the grooves or flutes 20 so that member 22 is prevented from further rotation relative to the base 14. The hand rest 42 is pivotally movable with respect to the member 22 so that it may be properly positioned. Assuming that the left hand is to be manicured first, one of the fingers of the left hand would be placed in the easel 32 and the right hand would then be rested upon the hand rest 42 so that the manicuring operations may be conveniently performed. The hand rest 42 is designed to support the manicuring hand in a steady position so that the manicuring hand will be supported slightly below the finger being supported. It can be appreciated that the hand rest 42 may be positioned in many various positions and may be supported at the other side of the assembly to permit it to support the left hand when the right hand is being manicured.

The hand rest 44 may be substituted for the hand rest 42 when overhand operations are to be performed on the finger being supported. Thus it can be seen that a novel manicure easel has been provided which not only provides a means for supporting the hand being manicured but which also provides a means for supporting the hand performing the manicuring operations. It can also be appreciated that the various rotatably or adjustment features of the assembly permits the convenient support of both the hands of the person. Thus it can be seen that the invention accomplishes at least all of its stated objectives.

I claim:

1. A manicure easel for selectively supporting one hand of a person in a manicure position and for supporting the other hand of the person in a position to enable the said other hand to perform manicure operations on the said one hand, comprising, a first support means adapted to be positioned on a horizontal supporting surface, a finger support on said first support means for supporting the tip portion of the finger to be manicured, and a hand rest secured to said first support means and extending laterally therefrom for supporting the said other hand, said hand rest comprising interchangeable first and second hand rest members, said first hand rest member dwelling in a vertical plane below said second hand rest member to permit the said other hand to be selectively positioned below and above the finger in said finger support respectively.

2.

A manicure easel for selectively supporting one hand of a person in a manicure position and for supporting the other hand of the person in a position to enable the said other hand to perform manicure operations on the said one hand, comprising, a first support means adapted to be positioned on a horizontal supporting surface, a finger support on said first support means for supporting the tip portion of the finger to be manicured, and a hand rest secured to said first support means and extending laterally therefrom for supporting the said other hand, said first support means comprising a base portion adapted to be removably secured to the supporting surface and a support assembly selectively rotatably mounted, about a vertical axis, on said base portion, said finger support being mounted on said support assembly, said hand rest being secured to said support assembly, and said hand rest selectively maintaining said support assembly in various rotatable positions with respect to said base portion.

* * * * *